United States Patent [19]

La Monica

[11] Patent Number: 4,558,573

[45] Date of Patent: Dec. 17, 1985

[54] DEVICE FOR OIL COOLING IN A COMPRESSION UNIT AND, PARTICULARLY, A SCREW COMPRESSION UNIT

[75] Inventor: Gaspare La Monica, Brugherio, Italy

[73] Assignee: Samifi Babcock, S.p.A., Milan, Italy

[21] Appl. No.: 655,023

[22] Filed: Sep. 26, 1984

[30] Foreign Application Priority Data

Sep. 30, 1983 [IT] Italy ..... 23071 A/83

[51] Int. Cl.[4] ..... F25B 43/02

[52] U.S. Cl. ..... 62/473; 62/84

[58] Field of Search ..... 62/84, 468, 470, 473

[56] References Cited

U.S. PATENT DOCUMENTS 3,283,532 11/1966 Kocher ..... 62/473

3,811,291 5/1974 Schibbye ..... 62/473

3,850,009 11/1974 Villadsen ..... 62/473

*Primary Examiner*—Ronald C. Capossela

[57] ABSTRACT

Device for oil cooling forming part of a mixture of compressed gas and oil from a compressor and directed to separator in a compression unit comprising an evaporator connected to said compressor, said separator being connected both to a condenser, in turn connected to said evaporator, and to said compressor by a conduit for oil supply to the compressor, characterized in that said conduit is connected by a line comprising an ejector to the conduit connecting the compressor to the separator, means being provided connecting the tank of the refrigerating fluid from the condenser to said ejector, so that a portion of oil from the separator passes through said ejector where vacuum is built up drawing a portion of the refrigerating fluid which is accordingly mixed with said mixture of compressed gas and oil to suitably cool down the oil forming part of said mixture.

3 Claims, 1 Drawing Figure

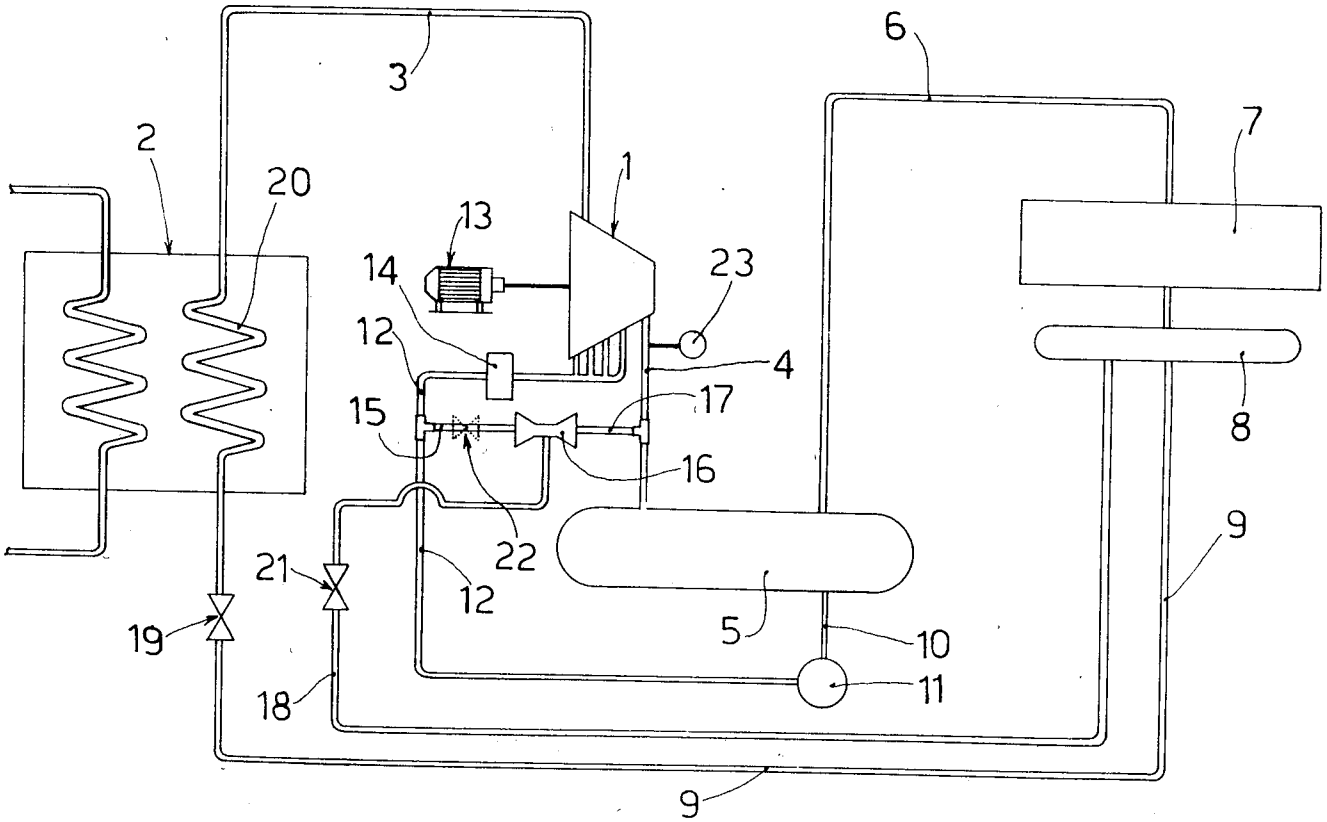
1
2
3
4
5
6
7
8
9
9
10
11
12
12
13
14
15
16
17
18
19
20
21
22
23

DEVICE FOR OIL COOLING IN A COMPRESSION UNIT AND, PARTICULARLY, A SCREW COMPRESSION UNIT

FIELD OF INVENTION

This invention relates to a device for oil cooling in a compression unit and, particularly, a screw compression unit.

BACKGROUND OF THE INVENTION

As well known, such compression units may be variously used, such as in refrigerating systems.

It is known that rotary compressors and particularly screw rotary compressors require a continuous injection of lubricating oil which, in addition to lubrication, also performs the function of subtracting part of the heat developed by compression work to maintain the operating temperature within reasonable limits. In turn, said oil has to be cooled down.

As well known, such units would comprise a separator, that is an apparatus supplied with the mixture of compressed gas and oil from the compressor; in said apparatus oil is separated from gas and the latter is then supplied to a condenser and therefrom to use, while oil is sent to the compressor by a pump.

Thus, in such a known type of unit, a chiller or cooler is provided dowstream of the separator on the line for oil return to the compressor, that is an apparatus suitably designed for oil cooling, so that oil returns to the compressor at cooled state. However, while achieving the object of sufficient oil cooling, said system has the disadvantage of being quite costly because of requiring a suitable apparatus, that is the above mentioned chiller or cooler. A cooling system has also been proposed which provides the use of a portion of the chilled liquid from said condenser and directed to the user. According to said system, some portion of liquid refrigerating fluid is injected in the compressor during compression step at a location where an intermediate pressure exists between suction pressure and exhaust pressure. However, by such a system the compressor performances are impaired.

SUMMARY OF THE INVENTION

It is the basic object of the present invention to overcome the above mentioned disadvantages and provide a suitable oil cooling in a simple and comparatively economical manner.

Such an object is achieved by the device according to the present invention which is essentially characterized in that the conduit, along which oil from the separator is supplied to the compressor (under the action of a pump) has a line branching off therefrom and comprising an ejector, directed to the conduit connecting the compressor to the separator, means being also provided for connecting the tank of the refrigerating fluid from the condenser to said ejector, whereby a portion of oil which through said pump is urged to the compressor passes through said ejector, wherein vacuum is built up returning a portion of the refrigerating fluid which, mixed up with said portion of oil, is then mixed up with said mixture of compressed gas and oil directed to the separator, so as to suitably cool down the oil forming part of the mixture exiting from the compressor.

BRIEF DESCRIPTION OF DRAWING

The accompanying drawing schematically shows an exemplary embodiment of the oil cooling device in a compression unit according to the present invention.

DESCRIPTION OF PREFERRED IMBODIMENT

More particularly, said example shown in the accompanying drawing, and hereinafter described, relates to a screw compression unit for use, for example, in a refrigerating system.

On the accompanying drawing, reference numeral 1 denotes a screw compressor actuated by a motor 13.

The inlet mouth of compressor 1 is connected by a conduit 3 to an evaporator 2, while the outlet mouth of said compressor is connected by a conduit 4 to a separator 5.

From the screw compressor 1 the mixture comprising compressed gas and oil arrives at the separator 5 along said conduit 4. By means of a conduit 6 the separator 5 is connected to a condenser 7, so that compressed gas exiting from said separator is supplied to said condenser 7 through said conduit 6.

The condenser 7 is connected to a tank 8 which, in turn, is connected to said evaporator 2 by a conduit 9. A throttling member 19 is provided along said conduit 9.

Oil exits from said separator 5 through a conduit 10 directed to a pump 11 and the latter returns oil to the compressor 1 through a conduit 12. Reference numeral 14 denotes a filter intended to be passed through by oil which arrives at compressor 1 through a conduit 12. Said conduit 12 has a conduit 15 branching off therefrom connected to an ejector, in turn connected to conduit 4 through a conduit 17, so that a portion of oil travelling the conduit 12 passes through the ejector 16 and is supplied to conduit 4, being therein mixed up with the mixture of compressed gas and oil from the compressor 1 and directed to the separator 5.

A conduit 18 branches off from the tank 8 and is connected to the ejector 16, so that the fluid travelling through said conduit is supplied (as further explained in the following) to the ejector 16, where it is added to the oil passing through said ejector.

Substantially, the operation of the device is as follows.

From the screw compressor 1 the mixture of compressed gas and oil exits and is directed along the conduit 4 to the separator 5, in which said oil and gas are separated. Said compressed gas is refrigerating fluid at gaseous state. Then, said gas is supplied along conduit 6 to the condenser 7, from which the fluid (liquid) is then supplied to the tank 8.

From said tank 8 the refrigerating fluid (at liquid state) is supplied to the coil 20 of evaporator 2 connected, as above mentioned, to the screw compressor 1 by said conduit 3.

From said separator 5 oil is supplied to the compressor 1 by said pump 11 along the conduit 12. Thus, an oil portion travelling through the conduit 12 arrives at the ejector 16 through the conduit 15 and then at conduit 4 through the conduit 17.

Vacuum is built up in said ejector 16, so that refrigerating fluid is returned through conduit 18 from compressor 1. Therefore, a mixture comprising oil and cold fluid is supplied from ejector 16 to conduit 4 along said conduit 17. The fluid being cooled during expansion and forming part of said mixture cools down the oil exhausted from said compressor 1 and directed to separator 5.

Substantially, some excess amount of oil leaving the conduit 12 directed to the ejector 16, passing through the latter as a drive fluid, at the minimum section builds up a sufficient vacuum to return the refrigerating fluid in the required amount to cool down the oil volume exhausted from the compressor, as mixed with the refrigerating fluid at gaseous state.

A suitable valve 21 controlled by proper automatisms provides for adjusting the required amount of refrigerating fluid to cool down at correct temperatures the oil discharged from the compressor 1 in said conduit 4. For example, said valve 21 is controlled by a (modular) thermostat 23 connected to conduit 4. Thus, the oil is suitably cooled without using a suitable exchanger.

Instead of valve 21, there could be provided along conduit 15 a valve 22 controlled by thermostat 23. This valve 22 is capable of varying the oil flow rate which is directed along conduits 15 and 17 to conduit 4, thus varying the flow rate of liquid which from conduit 18 is supplied to the ejector 16.

In screw compression units of known type a suitable exchanger is provided for oil cooling. On the other hand, in a unit as above described the need of such an exchanger is dispensed with and thus the unit is remarkably simplified.

It should also be noted that if liquid refrigerating fluid is directly injected in the compressor, during compression step, at a location where an intermediate pressure exists between section pressure (evaporator) and discharge pressure (condenser) the compressor performance would be impaired.

Instead, in a device according to the present invention, owing to the above described action of said ejector located on a line connecting the conduit run through by oil returning to the compressor with the discharge pipe of said compressor, a suitable oil cooling is obtained without impairing the compressor performances.

What is claimed is:

1. A closed refrigeration system comprising a screw compressor for refrigerant gas, an oil-gas separator, a condenser for condensing the compressed refrigerant gas, a receiver for condensed refrigerant and an evaporator, a first line for conducting compressed refrigerant gas from said compressor to said oil-gas separator, a second line for conducting compressed refrigerant gas from said separator to said condenser, a third line for conducting condensed refrigerant from said condenser to said receiver, a fourth line for conducting liquid refrigerant from said receiver to said evaporator, a fifth line for conducting refrigerant gas from said evaporator to said compressor, a sixth line for conducting oil from said oil-gas separator to said compressor, said sixth line comprising a pump for delivering oil under pressure to said compressor, a seventh line leading from a first junction in said sixth line downstream of said pump to a second junction in said first line between said compressor and said oil-gas separator, said seventh line having therein an ejector with a throat, and an eight line leading from said receiver to the throat of said ejector, whereby oil forced by said pump through said ejector in said seventh line produces in the throat of said ejector a vacuum for drawing refrigerant liquid from said receiver through said eight line into said seventh line.

2. A closed refrigerant system according to claim 1, further comprising means for sensing the temperature of compressed gas in said first line upstream of said second junction and a valve in said seventh line upstairs of said ejector controlled by said temperature sensing means in the manner that the opening of said valve is increased upon increase of said temperature.

3. A closed refrigeration system according to claim 1, further comprising means for sensing the temperature of compressed gas in said first line upstream of said second junction and a valve in said eight line controlled by said temperature sensing means in the manner that the opening of said valve is increased upon increase of said temperature.

* * * * *